US008974015B2

(12) United States Patent
Fischer

(10) Patent No.: US 8,974,015 B2
(45) Date of Patent: Mar. 10, 2015

(54) METHOD FOR CREATING A PRINTED IMAGE ON A ROTATING, THREE-DIMENSIONAL BODY

(71) Applicant: Heidelberger Druckmaschinen AG, Heidelberg (DE)

(72) Inventor: Joerg-Achim Fischer, Laboe (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 14/159,673

(22) Filed: Jan. 21, 2014

(65) Prior Publication Data

US 2014/0204135 A1 Jul. 24, 2014

(30) Foreign Application Priority Data

Jan. 18, 2013 (DE) ..... 10 2013 000 888

(51) Int. Cl.

| | |
|---|---|
| ***B41J 3/00*** | (2006.01) |
| ***B41J 29/393*** | (2006.01) |
| ***B41J 3/407*** | (2006.01) |
| ***B41J 11/00*** | (2006.01) |

(52) U.S. Cl.

CPC ..... *B41J 29/393* (2013.01); *B41J 3/4073* (2013.01); *B41J 11/0095* (2013.01)

USPC ..... 347/2

(58) Field of Classification Search

CPC ..... B41J 3/4073

See application file for complete search history.

(56) References Cited

U.S. PATENT DOCUMENTS

| | | | | |
|---|---|---|---|---|
| 5,043,740 | A | 8/1991 | Kneezel | |
| 7,955,456 | B2 | 6/2011 | Fischer et al. | |
| 2005/0248618 | A1 | 11/2005 | Pinard et al. | |
| 2011/0146880 | A1 * | 6/2011 | Kr mer et al. | 156/64 |

(Continued)

FOREIGN PATENT DOCUMENTS

| | | | |
|---|---|---|---|
| DE | 102008051791 | A1 | 4/2010 |
| DE | 102009014663 | A1 | 10/2010 |

(Continued)

OTHER PUBLICATIONS

German Patent and Trademark Office Search Report, Dated Oct. 4, 2013.

*Primary Examiner* — Julian Huffman

(74) *Attorney, Agent, or Firm* — Laurence A. Greenberg; Werner H. Stemer; Ralph E. Locher

(57) ABSTRACT

A method for creating a printed image on a rotating, three-dimensional body or bottle eccentrically on a turntable, includes providing an inkjet printing unit having inkjet nozzles along a straight line for printing at a clock rate, rotating the body about a rotation axis parallel to the line using a motor, prescribing a fundamental frequency $f_0(t)$ for activating the motor, for example based on a constant angular velocity, activating the motor with the fundamental frequency $f_0(t)$, prescribing an average or constant body radius $R_0$, determining a radius change $\Delta R(t)$ of the body during rotation, calculating a correction value k(t) for the printing unit clock rate, where $k(t)=1+\Delta R(t)/R_0$, and activating the printing unit with a frequency f(t) for the clock rate, where $f(t)=f_0(t)\cdot k(t)$, for example permitting printing on eccentrically rotating bottles with a constant print resolution while avoiding image imperfections.

9 Claims, 1 Drawing Sheet

(56) References Cited

U.S. PATENT DOCUMENTS

2011/0273726 A1 11/2011 Beckhaus
2012/0199021 A1* 8/2012 Till ..... 101/36

FOREIGN PATENT DOCUMENTS

DE 102009033810 A1 1/2011
JP 2001347656 A 12/2001

* cited by examiner

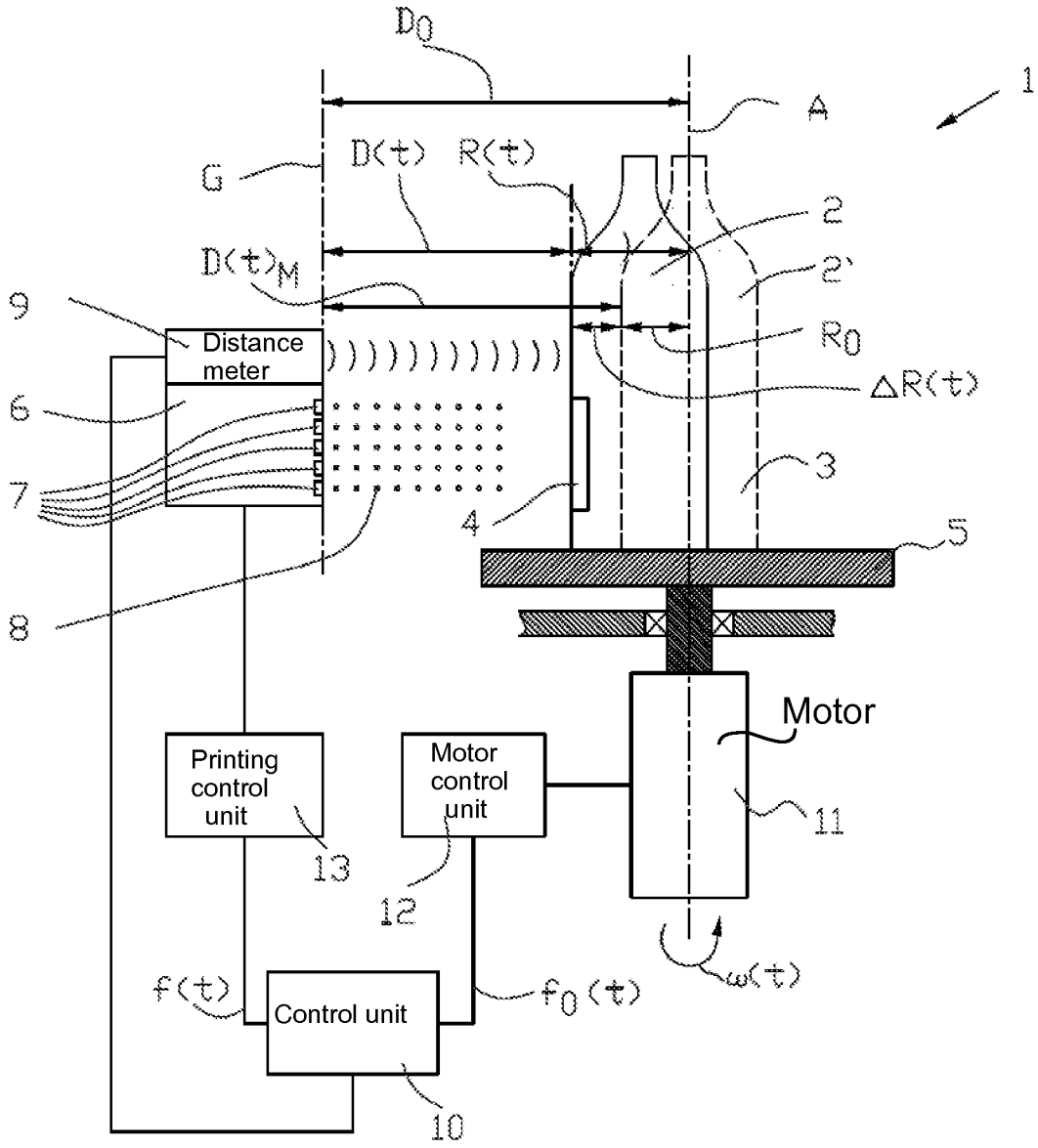
D0
A
1
G
D(t)
R(t)
2
2'
D(t)M
9
Distance meter
R0
ΔR(t)
6
3
7
4
5
8
Motor
Printing control unit
Motor control unit
11
13
12
f(t)
Control unit
f0(t)
ω(t)
10

METHOD FOR CREATING A PRINTED IMAGE ON A ROTATING, THREE-DIMENSIONAL BODY

CROSS-REFERENCE TO RELATED APPLICATION

This application claims the priority, under 35 U.S.C. §119, of German Patent Application DE 10 2013 000 888.3, filed Jan. 18, 2013; the prior application is herewith incorporated by reference in its entirety.

BACKGROUND OF THE INVENTION

Field of the Invention

The present invention relates to a method for creating a printed image on a rotating, three-dimensional body, which includes providing an inkjet printing unit having a plurality of inkjet nozzles disposed substantially along a straight line for printing at a printing clock rate, rotating the body about an axis of rotation substantially parallel to the straight line, driving the rotation of the body using a motor, prescribing a fundamental frequency for the activation of the motor, activating the motor with the fundamental frequency, and prescribing an average radius of the body.

U.S. Pat. No. 7,955,456 B2 already discloses the inkjet printing of blister packs. They have a substantially two-dimensional sealing foil to which printing is intended to be applied and are conveyed linearly. In spite of high production rates, the printing per se is therefore possible without any problem. Far more difficult is the application of printing to three-dimensionally formed bodies, with spatially curved outer surfaces, in particular since those bodies usually have to be rotated for printing.

However, it is also already known to apply printing to rotating, three-dimensional bodies, for example bottles in filling plants, by using an inkjet printing unit and it has also been recognized thereby that there is the problem that the rotating bodies may deviate from their desired position and imperfections in the printed image to be created may be caused as a result.

German Patent Application DE 10 2009 033 810 A1, corresponding to U.S. Patent Application Publication No. 2012/0199021 describes, for example, a plant for applying printing to containers. It mentions the problem that the centering of the mount or the container is critical for the application of printing at usually 600 dpi and high conveying speeds. The solution to the problem is that the print head is automatically adjustable, using sensors which determine the location and the angular position of the container and feed those values to a control device. However, adaptation of the clocking for the inkjet printing unit is not described.

German Patent Application DE 10 2009 014 663 A1, corresponding to U.S. Patent Application Publication No. 2011/0273726, describes the contactless (electrooptical or electromagnetic) determination of the rotational position of bottles by using a sensor unit and measuring markers. It is explicitly described in paragraph [0020] thereof that a longitudinal axis BA of the container corresponds approximately to an axis of rotation DA. Therefore, eccentrically rotating bottles are consequently not recognized as a problem and, correspondingly, no solution is offered either. Nor is adaptation of the clocking described.

However, bodies positioned eccentrically on a turntable constantly change their distance from a fixed printing unit, even when there is a constant angular velocity of the turntable, whereby the surface portion of the body which is facing the printing unit and to which printing is intended to be applied undergoes a constant change of the web speed or orbital velocity or rate of contour travel. As a result, noticeable, and therefore undesired, imperfections can occur in the printed image to be created because of a changing print resolution. Similar problems may occur if, although the body is held in a centered manner on the turntable, in the portion to which printing is intended to be applied its outer surface is not in the form of a cylinder or portion of a cylinder, or the angular velocity of the turntable changes. However, direct measurement of the web speed or the change thereof is not possible by using simple measures.

SUMMARY OF THE INVENTION

It is accordingly an object of the invention to provide a method for creating a printed image on a rotating, three-dimensional body, which overcomes the hereinafore-mentioned disadvantages of and is improved in comparison to the heretofore-known methods of this general type and which makes it possible to apply printing to rotating, three-dimensional bodies with a desired print resolution, even if the web speed of the surface portion to which printing is intended to be applied, and is therefore facing a printing unit, changes.

With the foregoing and other objects in view there is provided, in accordance with the invention, a method for creating a printed image on a rotating, three-dimensional body, which comprises providing an inkjet printing unit having a plurality of inkjet nozzles disposed substantially along a straight line for printing at a printing clock rate, rotating the body about an axis of rotation substantially parallel to the straight line, driving the rotation of the body using a motor, prescribing a fundamental frequency $f_0(t)$ for the activation of the motor, activating the motor with the fundamental frequency $f_0(t)$, prescribing an average radius $R_0$ of the body, determining the change in radius $\Delta R(t)$ of the body during the rotation of the body, calculating a correction value $k(t)$ for a printing clock rate of the printing unit, where $k(t)=1+\Delta R(t)/R_0$, and activating the printing unit with a frequency $f(t)$ for the printing clock rate, where $f(t)=f_0(t)\cdot k(t)$.

The method according to the invention makes it possible in an advantageous way to apply printing to rotating, three-dimensional bodies, for example bottles, or their (outer) surfaces or portions thereof with a desired print resolution, for example with a constant dpi value, by the inkjet process, even if the web speed of the surface portion to which printing is intended to be applied, and is therefore facing an inkjet printing unit, changes. According to the invention, during the rotation of the body, the change in radius thereof is determined at a preferably fixed measuring point. This change in radius at the measuring point may, for example, result from an eccentric positioning of the body, its non-cylindrical form or a change in the angular velocity of the rotation of the body.

According to the invention, the change in radius is used to calculate a correction value and the printing unit is activated with a frequency that is corrected with respect to the fundamental frequency. Consequently, according to the invention, the printing clock rate for the inkjet nozzles is adapted at the printing point to the change in radius and the associated change in the web speed of the (outer) surface portion to which printing is intended to be applied.

The measuring point and the printing point are therefore preferably chosen in such a way that they have at least one correlation. For example, the measuring point may lie ahead of the printing point in the direction of rotation of the body and the spatial distance may be converted into a distance over time and be taken into consideration in the activation of the printing unit. The measuring point may also be substantially identical to the printing point or offset parallel to the axis of rotation (the latter is preferably provided in the case of a radius of the body that does not change in the direction of the axis of rotation).

In this application, certain variables are given as dependent on time t, for example $f_0(t)$, $\Delta R(t)$, k(t) and f(t). As an alternative to this, these variables may also be given as dependent on the angle $\alpha$ of rotation, where $\alpha=\omega(t)\cdot t$, with $\omega(t)$ as the angular velocity of the rotation. With a constant angular velocity $\omega_0$, it is sufficient in this case to give the variables for the values $\alpha=0$ to 360°, or even in a narrower angular range if printing is intended to be applied only in this range.

The determination of the change in radius is preferably performed substantially directly in time before the printing. According to an alternative, however, it may also be provided that the determination of the change in radius is carried out a period of time before the printing, for example several seconds or minutes before, and the result is recorded in a control curve and this curve is used for correcting the frequency in the next printing operation. If the problem of the change in radius is substantially caused only by the (outer) form of the body, its form or change in radius within a complete revolution may also be permanently stored and then retrieved whenever printing is intended to be applied to such a body.

In accordance with another preferred mode of the method of the invention, the determination of the change $\Delta R(t)$ is performed as a contactless measurement with a distance meter, in particular with a triangulation measuring device. In comparison with distance meters or sensors that do not operate contactlessly, there is the advantage that the surface to which printing is intended to be applied or has already been applied is not subjected to any disturbing influences, for example due to deformation or abrasion, and as a result imperfections in the printed image can be advantageously avoided. Triangulation measuring devices or sensors also have the advantage that they can be used for measuring substantially all materials and that they allow very quick measurements. Alternatively, it may also be envisaged to use capacitively or inductively operating distance sensors.

In accordance with a further preferred mode of the method of the invention, the distance D(t) between the inkjet nozzles and the surface of the body is measured with the distance meter at the point at which the drops of ink are intended to impinge on the surface, where $\Delta R(t)=D(t)_M-D(t)$, with $D(t)_M$ as the average value over time of D(t). This procedure is advantageous in particular when a triangulation measuring device is used, since the device allows the distance from the surface, that is to say the distance D(t), to be measured directly. This distance can be used to calculate the change in radius.

In accordance with an added preferred mode of the method of the invention, $D(t)_M=D_0-R_0$ applies for the average value over time, with $D_0$ as the distance between the inkjet nozzles and the axis of rotation. Therefore, as long as $D_0$ and $R_0$ are known, the determination of D(t), and consequently also of $\Delta R(t)$, is very simple, for example when applying printing to bottles with a constant radius $R_0$ in the portion of the surface to which printing is intended to be applied and when positioning these bottles on a turntable with an axis of rotation at a constant distance $D_0$ from the inkjet nozzles.

In accordance with an additional preferred mode of the method of the invention, the prescription of an average radius $R_0$ of the body is based on the determination of $R_0=D_0-D(t)_M$, with $D_0$ as the distance between the inkjet nozzles and the axis of rotation and with $D(t)_M$ as the average value over time of D(t). Therefore, as long as, for example, the body has an irregular (outer) form, by contrast for example with a bottle with a known and constant $R_0$, it is advantageously possible to use averaging over a period of time that corresponds to a rotation by 360° (or less if printing is only intended to be applied to a portion of the circumference) to calculate $R_0$ on the basis of the given formula.

In accordance with yet another preferred mode of the method of the invention, an angular velocity $\omega(t)$ of the rotation of the body is prescribed, where $f_0(t)=\omega(t)\cdot R_0/a$ applies for the fundamental frequency, with a as the resolution of the printed image. Due to the proportionality between the angular velocity and the fundamental frequency, the latter can be calculated in a simple way with knowledge of the resolution to be achieved during the printing (for example as the smallest desired distance between the print dots in the circumferential direction).

In accordance with yet a further preferred mode of the method of the invention, the angular velocity is a constant $\omega 0$, and consequently the fundamental frequency $f_0$ is also a constant, where $f_0=\omega_0\cdot R_0/a$.

In accordance with a concomitant preferred mode of the method of the invention, the calculation of the correction value k(t) is performed substantially continuously. It may, for example, be envisaged to determine the change in radius continuously, at least continuously during a complete revolution of the body (or less if printing is only intended to be applied to a portion of the circumference) and to calculate from the value for $\Delta R(t)$ the value of k(t) and from that the value of f(t) for the activation. If the measuring point substantially coincides with the printing point or the time difference $\Delta t$ between measuring and printing is known, the use of high-speed computers and data links allows substantially real-time correction of the control frequency f(t) to be advantageously performed, possibly with a time difference of $\Delta t$.

The scope of the invention can also be seen as including a device for carrying out the aforementioned method according to the invention and developments thereof. Such a device has the components required for carrying out the method steps according to the invention: an inkjet printing unit with control, a motor with control, a distance meter and a computer for the calculations of the correction value.

Other features which are considered as characteristic for the invention are set forth in the appended claims.

Although the invention is illustrated and described herein as embodied in a method for creating a printed image on a rotating, three-dimensional body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing. The described invention and the described advantageous developments of the invention also represent advantageous developments of the invention in combination with one another.

BRIEF DESCRIPTION OF THE SEVERAL VIEWS OF THE DRAWING

The FIGURE of the drawing is a diagrammatic representation of a preferred exemplary embodiment of a device for applying printing to rotating bodies by carrying out the method according to the invention on the basis of sequences occurring during operation of the device.

DETAILED DESCRIPTION OF THE INVENTION

Referring now in detail to the single FIGURE of the drawing, there is seen a device 1 for applying printing, i.e. for creating a printed image, to or on rotating, three-dimensional bodies 2. A bottle to which printing is intended to be applied is shown by way of example, although it is not intended to apply printing to the complete surface 3 of the bottle, but only to a portion 4, for example a label or a banderole. The bottle is substantially rotationally symmetrical, but is not held in a centered manner on a turntable 5, i.e. its axis of symmetry does not coincide with an axis of rotation A of the turntable. Due to the (generally undesired) eccentric way in which the turntable is held, during the rotation of the turntable, and consequently of the body, a distance D(t) between the surface of the body 2 and an inkjet printing unit 6, or inkjet nozzles 7 thereof disposed substantially along a straight line G, changes over time t, and a radius R(t) changes over time. The radius R(t) is determined in this case as the distance between the surface 3 of the body directed toward the inkjet printing unit (a point of the surface at which drops of ink 8 are intended to impinge on the surface) and the axis of rotation A. The axis of rotation is aligned substantially parallel to the straight line G. Reference symbol $D_0$ denotes a substantially constant distance between the inkjet nozzles and the axis of rotation A and reference symbol $R_0$ denotes an average radius of the body, in the example the substantially constant radius of the bottle. Reference symbol $\Delta R(t)$ denotes a change in radius between the surface of the body directed toward the inkjet printing unit and a surface directed toward the inkjet printing unit of an imaginary body 2' held in a centered manner on the turntable. The distance between the surface directed toward the inkjet printing unit of the imaginary body 2' and the inkjet printing unit 6 is denoted by reference symbol $D(t)_M$. Reference symbol $D(t)_M$ may also be interpreted as an average value over time of the distance D(t) changing over time t.

The device 1 also has a distance meter 9, in particular a triangulation measuring device, with which the determination of the change in radius $\Delta R(t)$ is performed as a contactless measurement. The distance meter thereby initially measures the value of D(t). This value and its average value $D(t)_M$ can be used to calculate $\Delta R(t)$ on the basis of the formula $\Delta R(t)=D(t)_M-D(t)$. This calculation may be performed in a control unit 10, to which the result of the measurement D(t) is made available. In the simple case of the example of the bottle with a constant and known radius $R_0$, it is possible for $D(t)_M$ to be determined simply on the basis of the formula $D(t)_M=D_0-R_0$, from which $\Delta R(t)=D_0-R_0-D(t)$ is obtained. On the other hand, the prescription of the average radius $R_0$ of the body (for example if this body is not rotationally symmetrical, is flattened or is irregularly formed) may be based on the determination of $R_0=D_0-D(t)_M$.

The FIGURE also shows a motor 11 for driving the rotation of the body 2, i.e. in the example shown for the rotary driving of the turntable 5. The motor is activated with a prescribed fundamental frequency $f_0(t)$. For example, an angular velocity $\omega(t)$ of the rotation of the body may be prescribed by the control unit 10 and transferred to a motor control unit 12 and from the latter to the motor, where $f_0(t)=\omega(t)\cdot R_0/a$ applies for the fundamental frequency, with a as the resolution of the printed image. As long as the prescribed angular velocity is a constant $\omega_0$, the fundamental frequency is also a constant $f_0$, where $f_0=\omega_0\cdot R_0/a$. In the simple case, for example, a rotationally symmetrical body 2 with a constant radius $R_0$ is rotated with a constant angular velocity $\omega_0$, and with the body rotating eccentrically.

In order to print, the inkjet nozzles 7 require a printing clock rate f(t), at which the drops of ink are discharged. This printing clock rate is generated by the control unit 10 as a frequency and transmitted to a printing control unit 13 and from the latter to the printing unit 6. The activation of the printing unit with a frequency f(t) for the printing clock rate is performed according to the invention on the basis of the formula $f(t)=f_0(t)\cdot k(t)$, where k(t) is a correction value with respect to the frequency, with which the motor 11 is activated. The calculation of this correction value k(t) for the printing clock rate of the printing unit is performed according to the invention on the basis of the formula $k(t)=1+\Delta R(t)/R_0$. The following example clearly illustrates the underlying principle: if, during the rotation, the body 2 comes closer to the printing unit 6 with its surface 3, for example due to its eccentric positioning, the web speed or orbital velocity or rate of contour travel of the surface increases at the point at which the drops of ink 8 are intended to impinge, since these points are then at a greater distance (radius R(t)) from the axis of rotation A. Therefore, in order to maintain a prescribed resolution, the drops of ink must be discharged with a greater frequency. If the surface moves further away, the web speed is reduced and the frequency must correspondingly be lowered.

The calculation of the correction value k(t) is preferably performed substantially continuously. For this purpose, the distance D(t) is measured by the distance meter 9 continuously (or almost continuously or with a fundamental frequency of the order of magnitude of the printing frequency or greater) and this value is used in the control unit 10 for the calculation of the correction value k(t) and for the activation of the printing unit 6 at the printing clock rate $f(t)=f_0(t)\cdot k(t)$.

The invention claimed is:

1. A method for creating a printed image on a rotating, three-dimensional body, the method comprising the following steps:

providing an inkjet printing unit having a plurality of inkjet nozzles disposed substantially along a straight line for printing at a printing clock rate;

rotating the body about an axis of rotation substantially parallel to the straight line;

driving rotation of the body using a motor;

prescribing a fundamental frequency $f_0(t)$ for activation of the motor;

activating the motor with the fundamental frequency $f_0(t)$;

prescribing an average radius $R_0$ of the body;

determining a change in radius $\Delta R(t)$ of the body during rotation of the body;

calculating a correction value k(t) for a printing clock rate of the printing unit, where $k(t)=1+\Delta R(t)/R_0$; and activating the printing unit with a frequency f(t) for the printing clock rate, where $f(t)=f_0(t)\cdot k(t)$.

2. The method according to claim 1, which further comprises carrying out the step of determining the change in radius $\Delta R(t)$ as contactless measurement with a distance meter.

3. The method according to claim 2, wherein the distance meter is a triangulation measuring device.

4. The method according to claim 2, which further comprises measuring, with the distance meter, a distance D(t) between the inkjet nozzles and a surface of the body at a point at which drops of ink are intended to impinge on the surface, where $\Delta R(t)=D(t)_M-D(t)$, an $D(t)_M$ is an average value over time of D(t).

5. The method according to claim 4, wherein $D(t)_M = D_0 - R_0$ applies for the average value over time, where $D_0$ is a distance between the inkjet nozzles and the axis of rotation.

6. The method according to claim 4, which further comprises carrying out the step of prescribing the average radius $R_0$ of the body based on a determination of $R_0 = D_0 - D(t)_M$, where $D_0$ is a distance between the inkjet nozzles and the axis of rotation and $D(t)_M$ is an average value over time of D(t).

7. The method according to claim 1, which further comprises prescribing an angular velocity $\omega(t)$ of the rotation of the body, where $f_0(t) = \omega(t) \cdot R_0/a$ applies for the fundamental frequency and a is a resolution of the printed image.

8. The method according to claim 7, wherein the angular velocity is a constant $\omega_0$, and consequently the fundamental frequency $f_0$ is also a constant, where $f_0 = \omega_0 \cdot R_0/a$.

9. The method according to claim 1, which further comprises carrying out the step of calculating the correction value k(t) substantially continuously.

* * * * *